US012208867B2

(12) United States Patent
Ballantyne

(10) Patent No.: US 12,208,867 B2
(45) Date of Patent: Jan. 28, 2025

(54) MARITIME APPARATUS

(71) Applicant: SEA TRANSPORT DESIGN PTY LTD, Gold Coast (AU)

(72) Inventor: Ross Ballantyne, Gold Coast (AU)

(73) Assignee: SEA TRANSPORT DESIGN PTY LTD, Queensland (AU)

( * ) Notice: Subject to any disclaimer, the term of this patent is extended or adjusted under 35 U.S.C. 154(b) by 177 days.

(21) Appl. No.: 17/771,363

(22) PCT Filed: Oct. 22, 2020

(86) PCT No.: PCT/AU2020/051141
§ 371 (c)(1),
(2) Date: Apr. 22, 2022

(87) PCT Pub. No.: WO2021/077169
PCT Pub. Date: Apr. 29, 2021

(65) Prior Publication Data

US 2022/0315177 A1 Oct. 6, 2022

(30) Foreign Application Priority Data

Oct. 22, 2019 (AU) ..... 2019903979

(51) Int. Cl.
*B63B 35/00* (2020.01)
*B63B 3/38* (2006.01)
(Continued)

(52) U.S. Cl.
CPC ..... *B63B 35/00* (2013.01); *B63B 3/38* (2013.01); *B63H 5/07* (2013.01); *B63H 25/38* (2013.01); *B63B 2035/001* (2013.01)

(58) Field of Classification Search
CPC ..... B63B 35/00; B63B 2035/001; B63B 3/38; B63H 5/07; B63H 25/38
See application file for complete search history.

(56) References Cited

U.S. PATENT DOCUMENTS 759,536 A 5/1904 Manker
2,902,966 A 9/1959 Baer
(Continued)

FOREIGN PATENT DOCUMENTS

AU 733741 B2 5/2001

OTHER PUBLICATIONS

Authorized Officer: Joshua Hackworth, International Search Report and Written Opinion issued in PCT application No. PCT/AU2020/051141, Jan. 22, 2021, 9 pp.
(Continued)

*Primary Examiner* — Stephen P Avila
(74) *Attorney, Agent, or Firm* — Kaplan, Breyer, Schwarz LLP

(57) ABSTRACT

A grounding skeg for a landing craft configured for stem landing onto, and setting off from, a ground surface, the grounding skeg including: an elongate grounding body having a fore end and an aft end; and a removable pulling propeller functionally connected to the fore end of the body; wherein the pulling propeller is able to drive the landing craft ahead and astern; and the grounding body is locatable on the landing craft such that; the grounding body provides contact with the ground surface during stem landing of the landing craft; the fore end of the grounding body faces a bow end of the landing craft; and the aft end of the grounding body faces a stem end of the landing craft.

30 Claims, 6 Drawing Sheets

(51) Int. Cl.
*B63H 5/07* (2006.01)
*B63H 25/38* (2006.01)

(56) References Cited

U.S. PATENT DOCUMENTS

| | | | | |
|---|---|---|---|---|
| 3,105,455 | A | 10/1963 | Baldwin | |
| 3,483,838 | A | 12/1969 | Rath | |
| 5,503,100 | A * | 4/1996 | Shaw | B63B 1/24 114/274 |
| 6,792,886 | B1 * | 9/2004 | Maloney | B63B 27/143 114/70 |
| 2015/0000584 | A1 * | 1/2015 | Sancoff | B63B 1/14 114/312 |

OTHER PUBLICATIONS

Authorized Officer: Daniel Hearle, International Preliminary Report on Patentability issued in PCT application No. PCT/AU2020/051141, Nov. 26, 2021, 4 pp.

* cited by examiner

MARITIME APPARATUS

TECHNICAL FIELD

The invention relates to maritime apparatus including landing craft, and skegs and hulls for landing craft. In particular, the invention relates to grounding skegs for stern landing craft; hulls for stern landing craft including a grounding skeg; and stern landing craft including a grounding skeg.

BACKGROUND ART

Landing craft in the past have included substantially wide flat hulls (e.g. landing craft used to convey a landing force during an amphibious assault). This enables the landing craft to be driven from the sea to the shore until the ramp, usually at the bow end, is beached. By dropping the ramp the transported items within the craft can be moved to the shore.

More recently, stern landing craft have been proposed to address the operational problems of conventional landing craft. These craft were adapted to permit landing of the stern of the craft on the shore, and a particular example is disclosed in Australian Patent no. 733741, which refers to disadvantages with conventional landing craft in relation to deck space, dead weight and total lane length, among other items.

A feature of some stern landing craft is the use of keel devices (pods) designed to address the problem of protecting the propellers when landing. This is achieved by placing the running gear inside the 'pods' and the propellers being protected by large tongues/pads extending aft that buffer the beach/sand/rocks from hitting the propellers. However, the propellers in such configurations would still be exposed to potential damage as they are not protected around the edges and those edges could come into contact with the shore upon landing. Where the landing surface is not firm (e.g. sand, mud or pebbles), and the skegs sink into the landing surface, this increases the likelihood of propellers hitting their surroundings.

Additionally, some landing craft include a rudder outboard of the propeller shaft, however rudders in this location are prone to being damaged during beaching. Inboard located rudders may similarly be damaged during beaching. Further, depending on the relative location of the rudder to the propeller, the rudder may interfere with removing the propeller shaft for inspection, or repair, etc.

Existing landing craft may be deficient in one or more other respects, such as in some cases: not providing efficient operation of the propellers when driving the craft off the landing surface as the propellers are not rotating in the optimum orientation (i.e. they rotate in the opposite to usual direction to drive the craft off the landing surface); having limited manoeuvrability; and in relation to hull configuration, not having configurations that are conducive to effective landing and setting off of a craft designed to unload items onto, or receive items from, the shore.

It is to be understood that any prior art information referred to herein does not constitute an admission that the information forms part of the common general knowledge in the art in Australia, or the equivalent general background knowledge in any other country.

SUMMARY OF INVENTION

The present invention arises from a recognition that improvements in landing craft and skegs can be achieved by providing a grounding skeg, or a craft hull incorporating a grounding skeg, or a craft, that addresses one or more of the shortcomings of the prior art, or at least provides a useful alternative thereto.

According to a first aspect of the invention, there is provided a grounding skeg for a landing craft configured for stern landing onto, and/or setting off from, a ground surface, the grounding skeg including: a grounding body having a fore end and an aft end; and a pulling propeller functionally connected to the fore end of the body; wherein the pulling propeller is able to drive the landing craft ahead and astern; and the grounding body is locatable on the landing craft such that: the grounding body provides contact with the ground surface during stern landing of the landing craft; the fore end of the grounding body faces a bow of the landing craft; and the aft end of the grounding body faces a stern of the landing craft.

The landing craft may be configured for landing the bow of the craft on a ground surface.

Preferably, the grounding body is elongate in shape. The elongate grounding body is longer in its length (i.e. from its fore end to its aft end) than its width (i.e. from a starboard side to a port side of the grounding body).

Preferably, the pulling propeller is removable from the grounding skeg.

The pulling propeller preferably includes a propeller shaft that is removably attached to the skeg and/or one or more propellers.

The grounding skeg is preferably adapted to aid the landing craft in stern landing onto and/or setting off from a ground surface comprising sand, mud, pebbles and/or other material comprising a seabed surface, and in particular material that is able to be displaced or compressed by the landing craft during landing and/or setting off.

When driving the landing craft ahead, the pulling propeller preferably rotates in a first direction (e.g. clockwise) and is adapted to pull the landing craft ahead through the water from the fore end of the grounding skeg. When driving the landing craft astern, the pulling propeller preferably rotates in a second direction (e.g. counter-clockwise) and is adapted to push the landing craft astern through the water from the fore end of the grounding skeg.

Preferably, the grounding body is adapted to be located on the landing craft such that the aft end of the grounding body provides the first point of contact with the ground surface during stern landing of the landing craft.

In a particularly preferred form, the grounding body includes a tapered end. The grounding body may taper in its depth (i.e. from an upper part to a lower part of the grounding body) and/or taper in its width (i.e. from a starboard side to a port side of the grounding body). Alternatively, the grounding body may not be tapered in either its width and/or length.

In a preferred form, the grounding skeg includes a rudder. The rudder preferably includes a rudder blade located at, or towards, the aft end of the grounding body. The rudder and/or rudder blade may be removable from the skeg.

Preferably, the rudder blade is at least partially housed within the body. In a preferred form, the grounding body is adapted to protect the rudder and/or rudder blade during stern landing and/or setting off of the landing craft.

The grounding body preferably includes a protective housing around at least the lower portion of the rudder blade, to protect the rudder blade from the ground surface during stern landing and/or setting off of the landing craft. Preferably, the protective housing comprises a shoe to protect the rudder. Preferably, the shoe is sacrificable and can be replaced if it becomes damaged. The shoe may be made from a material or combination of materials including stainless steel, mild steel, aluminium, GRP, FRP or carbon fibre. In a particularly preferred form, the protective housing (or shoe) is replaceably attached to the grounding body. Alternatively, the protective housing (or shoe) may be integrally formed with the grounding body.

In a preferred form, the rudder blade is housed at an end of the body and the aft end of the body includes a shoe to protect the rudder blade. In a particularly preferred form, the shoe has a generally triangular shape. It is further preferred that the shoe includes a pointed tip comprising the aft-most end of the grounding body.

Preferably, the grounding body includes a tapered end, and the rudder blade is housed within the tapered end of the body. In a preferred form, the aft end of the grounding body is tapered, and the rudder blade is housed within the tapered aft end of the body.

Alternatively, the rudder blade may be housed in a different part (e.g. mid-section) of the grounding body, which may be tapered or may not be tapered.

It is preferred that a fore end of the rudder blade has substantially the same width as, or is narrower than, a part of the grounding body that houses the fore end of the rudder blade. In a preferred form, the fore and aft end taper in a manner that is substantially similar. It is particularly preferred that the fore end of the rudder blade has substantially the same width as, or is narrower than, a tapered aft end of the grounding body that houses the fore end of the rudder blade.

It is preferred that an aft end of the rudder blade has substantially the same width as, or is narrower than, a part of the grounding body that houses the aft end of the rudder blade. It is particularly preferred that the aft end of the rudder blade has substantially the same width as, or is narrower than, a tapered aft end of the grounding body that houses the aft end of the rudder blade.

Preferably, the rudder blade is tapered such that, when the rudder blade is oriented to be in-line with the grounding body, an outer surface of the grounding body forms a substantially continuous surface with the rudder blade.

Preferably, the or each grounding skeg is configured such that the parts of the skeg including the propeller; the propeller shaft, the grounding body and the rudder (where a rudder is applied) are contiguously located, in the sense that each part is contiguous with at least one other part. Preferably, the component parts of the grounding skeg comprise a single structure. Alternatively, the grounding skeg may include two or more non-contiguous structures, such as a first structure including the pulling propeller and having a first grounding body, the first structure being separate to a second structure including the rudder and having a second grounding body.

Preferably, the or each grounding body is a unitary structure. Alternatively, the grounding body may comprise a plurality of non-unitary portions.

Where a rudder is present, the rudder and/or rudder housing may comprise a first portion of the grounding body that is non-unitary with the rest of the grounding body comprising a second portion of the grounding body (the second portion of the grounding body being functionally connected to the pulling propeller). In this configuration, the first and second grounding body portions are contiguous. In alternative preferred forms, such first and second (or further) grounding body portions may not be contiguous. The grounding skeg comprising two separate structures described above is one preferred embodiment of a grounding skeg including a plurality of non-contiguous structures, and similarly, other multiple structure grounding skegs arrangements would fall within the scope of the invention.

Preferably, the pulling propeller is able to be removed from the grounding skeg independently of the rudder. Preferably, the propeller shaft is able to be removed from the grounding skeg. It is particularly preferred that a propeller shaft connected to the pulling propeller is able to be removed from the grounding skeg independently of the rudder.

Preferably, grounding skeg houses an electric motor or a conventional combustion engine, or a part thereof, for operating the pulling propeller.

In a preferred form. the grounding skeg is attachable to a hull of the landing craft. In a particularly preferred form, the grounding skeg is able to be retrofitted to the hull.

The propeller is preferably adapted to drive the landing craft astern while the grounding body (and in a particularly preferred form, the aft end of the grounding body) provides contact with the ground surface during stern landing of the landing craft.

Preferably the at least one propeller blade(s) are sized and/or located to not exceed a lowermost extremity the grounding skeg. In a particularly preferred form, the at least one propeller blade(s) are sized and/or located to not exceed a lowermost extremity of the fore end of the grounding skeg proximate to the propeller.

Preferably the size of the propeller and its location at the fore end of the elongate grounding body enables the propeller to drive the landing craft astern while the grounding body provides contact with the ground surface during stern landing of the landing craft. The location of the propeller includes its location relative to the geometry of the grounding skeg such that the propeller blades do not exceed the lowermost extremity of the grounding skeg.

Preferably the propeller is adapted to provide a sternwards thrust resulting from the propeller continuing to drive the landing craft sternwards while the grounding body provides contact with the ground surface during stern landing of the landing craft.

In a particularly preferred form, the propeller is adapted to provide an additional sternwards thrust to an extant sternwards momentum of the landing craft during stern landing, said additional thrust combining with the extant sternwards momentum to drive the stern landing vessel further into the ground surface than would otherwise be the case (i.e. without said additional sternwards thrust).

It is particularly preferred that the propeller is adapted to continue rotating and providing sternwards thrust while a substantial portion of the grounding skeg is grounded. Preferably, the substantial portion includes at least a quarter or a third of the length of the elongate grounding skeg. The quarter or third length preferably extends from the aft end of the grounding skeg towards the mid-section of the grounding skeg.

According to a second aspect of the invention there is provided a hull for a landing craft, the hull including at least one grounding skeg having one or more of the features described herein.

In a preferred form, the at least one grounding skeg comprises one grounding skeg located on a hull centreline.

Preferably, the at least one grounding skeg comprises one or more grounding skegs on each side of a hull centreline.

In a preferred form, the at least one ground skeg comprises two grounding skegs, one grounding skeg being located on one side of the hull centreline, and the other grounding skeg being located on the other side of the hull centreline.

In a particularly preferred form, the at least one ground skeg comprises three skegs: one skeg located on the hull centreline and one grounding skeg on each side of the hull centreline.

In a further particularly preferred form, the at least one ground skeg comprises four skegs: two grounding skegs are located on each side of the hull centreline.

Preferably, two or more grounding skegs are located at an outboard location, and each grounding skeg is adapted to independently control the landing or setting off of the landing craft.

In a preferred form, the at least one grounding skeg has a draft that is substantially similar to, or slightly greater than, the hull draft.

Preferably, the at least one grounding skeg is located aft of the midships of the landing craft. In a preferred form, the at least one grounding skeg, or at least a substantial portion of the at least one grounding skeg, is located proximate to the stern end of the landing craft.

Preferably, the hull is V-shaped.

In a preferred form, the at least one grounding skeg is removably attachable to the hull.

In a preferred form of the invention there is provided a hull for a landing craft including the features described herein, wherein the hull is adapted to receive a retrofit grounding skeg having the features described herein. Preferably, the hull includes at least one elongate planar surface for retrofit engagement with an elongate upper surface of the ground skeg.

According to a third aspect of the invention, there is provided a grounding skeg for a landing craft, the grounding skeg including: a body; and a removable pulling propeller functionally connected to the body; wherein the pulling propeller is able to drive the stern landing craft ahead and astern.

The body may be made from a material or combination of materials including high tensile steel, mild steel, aluminium, GRP, FRP, carbon fibre or one or more other hardened materials known to the skilled person in the art.

The body may include a tapered end. The tapered end of the body may include a pointed tip. The pointed tip may be for hydrodynamic performance. The tapered end may be made from a material or combination of materials including stainless steel, mild steel, aluminium, GRP, FRP or carbon fibre.

The body may include a first tapered end, and a second tapered end, the second tapered end opposing the first tapered end of the body.

The grounding skeg may include a rudder. The rudder may be at least partially housed within the body.

A rudder blade of the rudder may be at least partially housed within the body in a rudder blade housing. Preferably, the rudder blade housing is adapted for protecting the rudder blade during grounding of the landing craft.

The rudder blade is preferably housed within the tapered end of the body. The rudder blade may be tapered. The rudder is preferably tapered such that, when the rudder blade is in-line with the grounding skeg body, an outer surface of the grounding skeg forms a substantially continuous surface with the rudder blade.

Preferably, the fore end of the rudder blade has substantially the same width as, or is narrower than, the grounding skeg body that houses the fore end of the rudder blade. Preferably, the aft end of the rudder blade has substantially the same width as, or is narrower than, the grounding skeg body that houses the aft end of the rudder blade.

The body may form a protective housing around at least the lower portion of the rudder blade, to protect the rudder blade during grounding of the landing craft.

The pulling propeller is preferably located at a first end of the grounding skeg, and the rudder is located at a second opposing end of the grounding skeg.

The rudder may be located towards a first end of the body, and the pulling propeller located towards a second opposing end of the body. The rudder may be located towards the aft end of the grounding skeg.

The pulling propeller is preferably able to be removed independently of the rudder.

The grounding skeg may house an electric motor for operating the propeller.

The grounding skeg may house a conventional combustion engine, or a part thereof, for operating the propeller.

The grounding skeg may house a connection means to connect the propeller to an engine which is located partly, or wholly, outside the skeg body.

The engine is preferably located partly, or wholly, within a hull of the landing craft.

The grounding skeg may be attachable to a hull of the landing craft.

The grounding skeg body may include an upper surface. In a preferred form, the upper surface is attachable to a hull of the landing craft.

In a preferred form, the upper surface is an interchangeable upper section to enable the upper surface of the skeg body to match a surface of the hull.

The grounding skeg is preferably able to be retrofit to the hull.

The grounding skeg may be able to be attached or retrofit by welding onto the hull.

The grounding skeg is preferably able to be attached or retrofit by bolting onto the hull.

According to a fourth aspect of the invention, there is provided a hull for a landing craft, the hull including at least one grounding skeg having one or more of the features described herein.

Preferably, the hull includes a keel and one or more grounding skegs located on either side of the keel.

The at least one grounding skeg may have a depth that is substantially similar to, or slightly greater than, the keel depth.

Preferably, two or more grounding skegs are located at an outboard location (here, in the sense of being located away from the centre line of the craft), and one or more grounding skeg is locatable at an inboard location (in the sense of being located toward the centre line of the craft), the outboard located grounding skegs being adapted to independently control the landing or setting off of the landing craft.

The at least one grounding skeg may be located aft of the midships of the landing craft.

The at least one grounding skeg may be located proximate to the stern of the landing craft.

The propeller may be located aft of the midships of the landing craft.

The hull is preferably configured such that the at least one grounding skeg provides the first point of contact with the ground during landing of the landing craft.

The hull may be configured such that the aft end of the at least one grounding skeg provides the first point of contact with the ground during landing of the stern landing craft. Alternatively, the hull may be configured such that the main hull or the keel could provide the first point of contact.

Preferably, the hull is generally V-shaped.

The at least one grounding skeg may be integrally formed with the hull. In a preferred form, the at least one grounding skeg includes an open upper section accessible from above and within the hull. Alternatively, the at least one grounding skeg may have a closed upper section and be removably attachable to the hull.

The hull may include one or more longitudinal rubbing strakes to protect the hull. Preferably, the one or more rubbing strakes are sacrificable. Preferably, the one or more rubbing strakes include a half-round pipe; alternatively, the one or more rubbing strakes may include suitable fabricated bars having a different configuration.

Preferably, the half-round pipe is made from a material or combination of materials including steel.

The hull may be adapted to receive a retrofit grounding skeg as described above.

The hull may include at least one planar surface for retrofit engagement with an upper surface of the grounding skeg. The planar surface may comprise an elongate surface extending approximately from the stern to the midships of the hull.

In a fifth aspect of the invention, there is provided a stern landing craft including one or more grounding skegs as described herein.

In a sixth aspect of the invention, there is provide a stern landing craft including a hull as described herein.

The features described in relation to one or more aspects of the invention are to be understood as applicable to other aspects of the invention.

Other aspects of the invention are also disclosed.

DESCRIPTION OF EMBODIMENTS

A grounding skeg, craft hull and craft are described and depicted herein in connection with illustrative but non-limiting preferred embodiments for a particular application, namely a retrofit grounding skeg, and a craft including an integrated grounding skeg.

The structure, principle and operation of the described grounding skeg, craft hull and craft may be understood by reference to FIGS. 1A to 4, as will be appreciated by those skilled in the art.

Structure

Figure 1A:
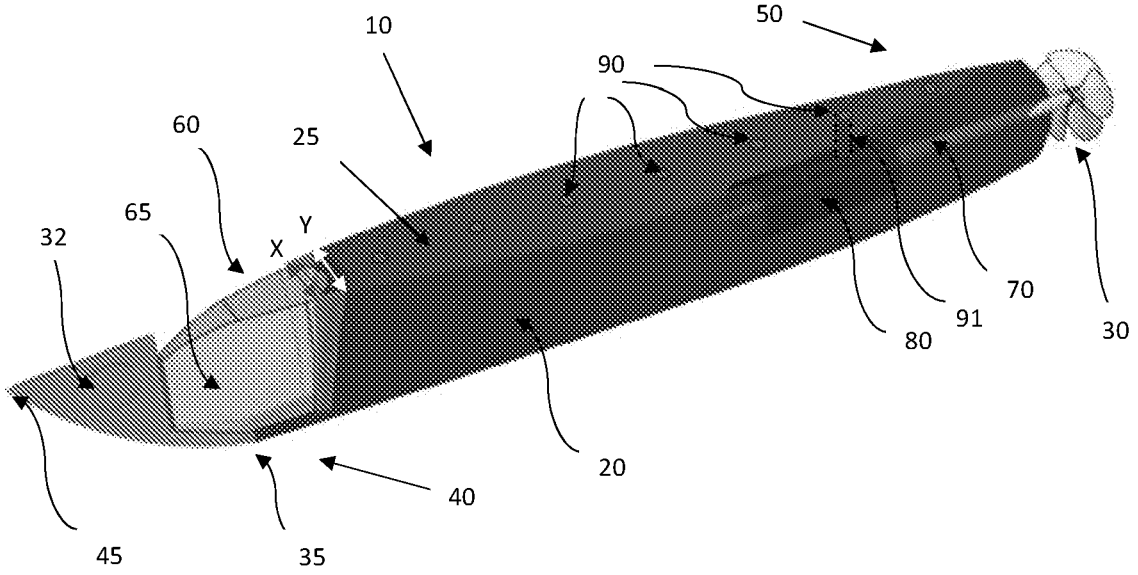
FIG. 1A is a schematic drawing of a grounding skeg according to a preferred embodiment of the present invention.

FIG. 1A depicts grounding skeg 10 for a landing craft, including body 20, removable propeller 30 functionally connected to the body 20 via propeller shaft 70 and electric motor 80.

The propeller 30 is able to rotate in a first direction to propel the skeg 10, and craft with respect to which it may be attached or integrated, in a first direction (e.g. ahead; the direction could alternatively be sideways, or a combination of sideways and ahead). The propeller 30 is additionally able to rotate in a second direction, the second direction being opposite to the first direction, to propel the skeg, and craft with respect to which it may be attached or integrated, in a second direction (e.g. astern, but could alternatively be sideways, or a combination of sideways and astern).

In the non-limiting embodiment of FIG. 1A, the blades of the propeller 30 have a fixed pitch with respect to the propeller shaft 70. The fixed pitch blade arrangement provides for a high propulsion efficiency when rotating in the first direction to propel the skeg/craft ahead, and a relatively lower efficiency when rotating in the second direction to propel the skeg/craft astern. In an alternative embodiment (not shown), controllable pitch or variable pitch propellers may be employed to offer more efficiency, albeit at an increased monetary cost.

The body 20 is made from high tensile steel. Alternatively, mild steel or other suitable material known to the person skilled in the art may be used. The grounding skeg 10 includes a first tapered (aft) end 40 having a pointed tip 45.

The first tapered end 40 includes a triangular section 32, the pointed tip 45 comprising one corner thereof. The triangular section 32 is made from stainless steel and operates as a sacrificable 'shoe' to protect the rudder, and is a component that can be replaced if it becomes damaged.

The first tapered end 40 tapers from approximately from the middle portion of the body 20 in the direction towards the pointed tip 45.

The body 20 includes a second tapered end 50 located opposite the first tapered end 40.

The second tapered (fore) end 50 tapers from approximately the middle portion of the body 20 in the direction of the propeller 30. The second tapered end 50 is generally wedge shaped having a generally continuous tapering in the direction of the propeller 30.

The pointed tip 45, and pointed ends 40, 50, provide for hydrodynamic performance to provide improved water flow into the propellers, without 'snagging' the skeg/craft in the scenario they contact a ground surface (e.g. seabed when operating in shallow waters).

The first tapered end 40 includes a rudder blade 65 that tapers in the direction towards the pointed tip 45. The rudder 60 is partially housed by the body 20 (the rest of the rudder 60, including the rudder stock, is not shown in FIG. 1A). The rudder blade 65 has a width which tapers in the direction towards the pointed tip 45. The rudder blade 65 is substantially wedge shaped. The rudder blade 65 is housed in a 'shoe' comprising the triangular section 32 and the connection portion 35 which connects the triangular section 32 to the rest of the body 20; the rudder blade 65 is also housed by the section of the body 20 proximate to the thicker end of the rudder 60. The 'shoe' housing the rudder blade 65 in this way protects the rudder blade 65 from forces that, without the 'shoe', would otherwise act on the blade 65 during grounding of the landing craft.

In an alternative form (not shown), the rudder blade 65 may be located closer towards the middle portion of the skeg body 20 in order to better protect the rudder blade 65 during grounding of the craft. In a further alternative (also not shown), to provide improved steering control, the rudder blade 65 may be located further towards the pointed end 45.

The width of the thicker end of rudder blade 65 (represented by the shorter double pointed arrow on FIG. 1A, and labelled "X") is slightly narrower than the portion of the grounding skeg body 20 that houses the thicker end of the rudder blade 65 (represented by the longer double pointed arrow on FIG. 1A, and labelled "Y").

The rudder blade 65 is tapered such that, when the rudder blade 65 is in-line with the longitudinal axis of the grounding skeg body 20 (as is depicted in FIG. 1A), an outer surface of the grounding skeg body 20 forms a substantially continuous surface with the rudder blade 65. The triangular section 32 is approximately the same width as the thinner end of the rudder blade 65.

During grounding, the rudder blade 65 is protected by the housing 20 when the blade 65 is amidships (i.e. kept in-line with the longitudinal axis of the skeg body).

The rudder blade 65 is able to pivot or rotate with respect to the grounding skeg body 20, where the pivoting takes place about the thicker end "X" of the wedge shaped rudder blade 65.

The pulling propeller 30 or the propeller shaft 70 may be removed or disconnected from the grounding skeg 10 independently of the rudder 60. The rudder blade 65 is therefore not required to be removed in order to remove the pulling propeller 30 or the propeller shaft 70. The pulling propeller 30 may be connected to the propeller shaft 70, or alternatively directly to the body 20, independently of the rudder 60; the propeller shaft 70 may also be inserted into or connected to the body 20 independently of the rudder 60.

The grounding skeg 10 includes attachment means 90 (only four of which attachment means have been labelled for the purposes of diagrammatic clarity) for attaching or retrofitting the grounding skeg 10 to the hull of a landing craft. Attachment means 90 comprise bolt holes for bolting the grounding skeg 10 to the hull of a landing craft. Alternatively, attachment means (not shown in FIG. 1A) may comprise welding the grounding skeg 10 to the hull.

The grounding skeg 10 houses connection means (comprising a tubular connecting port 91 extending through one of the attachment means 90) to connect the electric motor 80 to a controller which is located outside the skeg body 20.

In the grounding skeg depicted in FIG. 1A, the upper surface 25 of the grounding skeg 10 comprises a planar surface 25 which is adapted to match a planar surface of the hull to which the grounding skeg 10 is attached or retrofit.

The grounding skeg 10 is able to be retrofit to a hull of a landing craft, by retrofitting bolts that extend from the hull into to the body 20 of the grounding skeg 10 via the bolt holes 90. Alternatively, the grounding skeg 10 may be welded onto the hull of a landing craft (not shown); the grounding skeg 10 may in a further alternative configuration (not shown) be open into the hull of the craft.

In some embodiments the grounding skeg 10 may include an interchangeable upper section (not shown) to enable the upper surface of the skeg body 20 to match a surface of the hull. The interchangeable upper section may include a lower surface adapted to match the planar surface 25 of the grounding skeg 10, the interchangeable upper section further including an upper surface which is shaped to match a surface of the hull to which the grounding skeg 10 it to be attached or retrofit.

The grounding skeg 10 is made to be watertight so as to be suitable for retrofitting. Watertight seals are provided in the attachment points 90 for housing electrical connections (not shown) to connect the electric motor 80 to a power source and controller in the craft.

Alternatively, the electric motor 80 may include a wireless receiver so that it may be wirelessly controlled.

The grounding skeg 10 includes the power source within the body 20 of the skeg. Alternatively, mechanical connections may be provided to connect the propeller shaft 70 to a motor located in the craft (for example, a vertical rotating shaft may be rotatably engaged, via a gearbox, with the propeller shaft 70, whereby rotation of the vertical rotating shaft is effected by a conventional combustion engine located in the hull of the craft, and the combustion engine thereby drives the propeller 30).

Mechanical and/or electrical connections (also not shown), may be provided to connect the rudder 60 to rudder stock which is located in the hull 200 of the craft 100.

It will be understood by the person skilled in the art that the configuration of the grounding skeg presented in FIG. 1A is just one form of skeg that falls within the scope of the invention the subject of this specification. The grounding skeg 10 need not be retrofittable to a hull, (i.e. it may be integrally formed with a hull; they may also be open into the hull), the shape of the skeg body 20 may be different to that illustrated, the rudder 60 may be located separately to the skeg, etc. Alternative embodiments of the grounding skeg the subject of the invention are depicted in FIGS. 1B to 1E, which are described in more detail below.

Figure 1B:
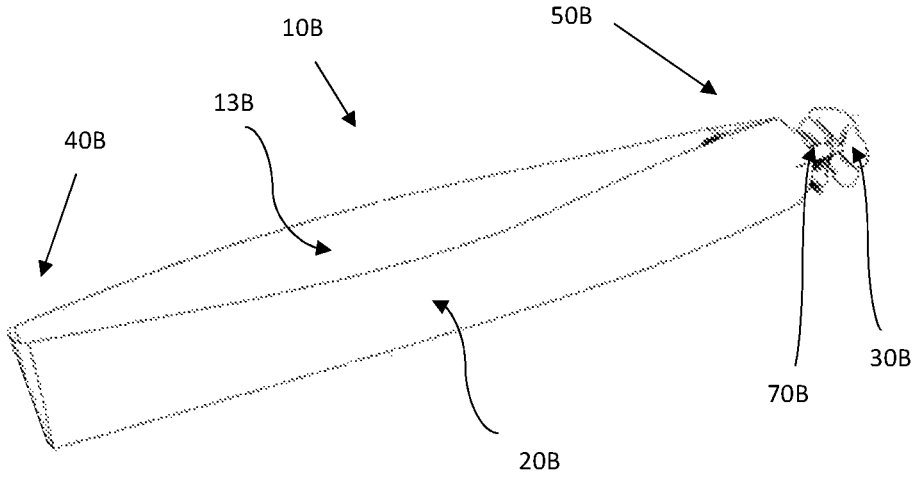
FIG. 1B is a schematic drawing of a grounding skeg according to a second preferred embodiment of the invention.

Referring to FIG. 1B, there is depicted a grounding skeg 10B for a landing craft, including body 20B, and propeller 30B functionally connected to the body via propeller shaft 70B. The skeg 10B has a rounded aft end 40B for facing a stern end of the landing craft, whereas the fore end 50B has a wedge shape. An upper section 13B of the grounding skeg 10B is open and accessible from above. When located on the hull of a craft (not shown in FIG. 1B), this means the grounding skeg 10B may be accessed from within the hull.

Figure 1C:
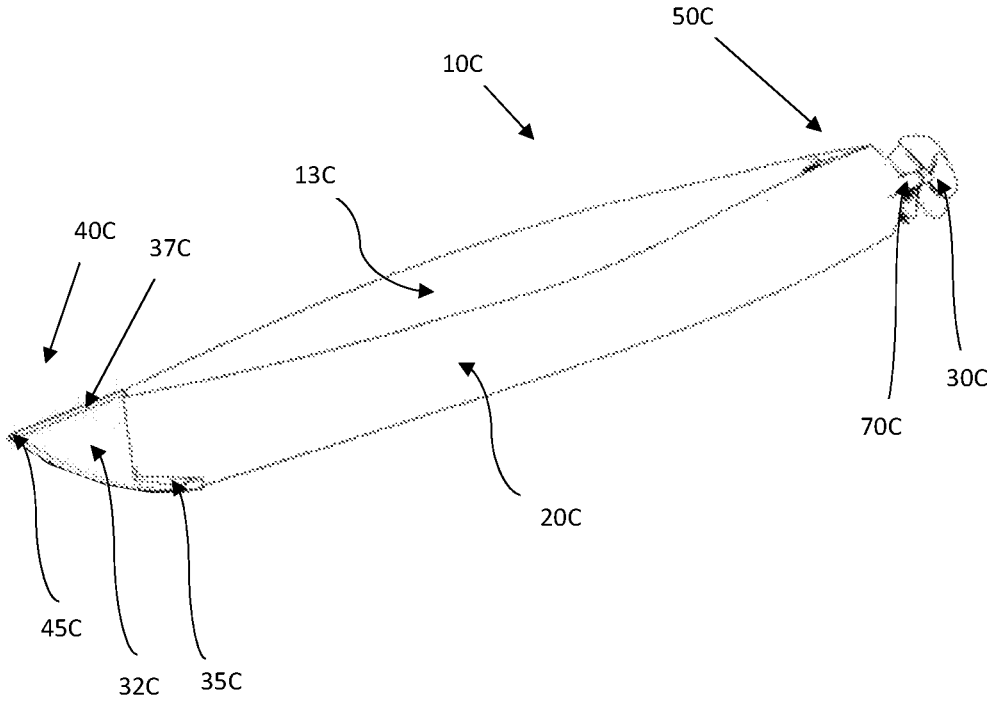
FIG. 1C is a schematic drawing of a grounding skeg according to a third preferred embodiment of the invention.

Referring to FIG. 1C, there is depicted a grounding skeg 10C for a landing craft, including body 20C, and removable propeller 30C functionally connected to the body via propeller shaft 70C. An upper section 13C of the grounding skeg 10C is open and accessible from above. The aft end 40C of the skeg 10C is for facing a stern end of the landing craft. Compared with the shape of the skeg depicted in FIG. 1B, the grounding skeg 10C illustrated in FIG. 1C has a finer aft end 40C for improved hydrodynamic performance going astern, by providing improved water flow into the propeller 30C.

The aft end 40C of the grounding skeg 10C includes a sacrificial strengthened shoe 37C comprising triangular section 32C including a pointed tip 45C in the aftmost corner, and a connection portion 35C for connecting to the body 20C of the skeg 10C. The triangular section 32C and connection portion 35C are made of stainless steel (alternatively, they may be made of other hardened material). The sacrificable 'shoe' 37C operates to protect the skeg, and is a component that can be replaced if it becomes damaged.

Figure 1D:
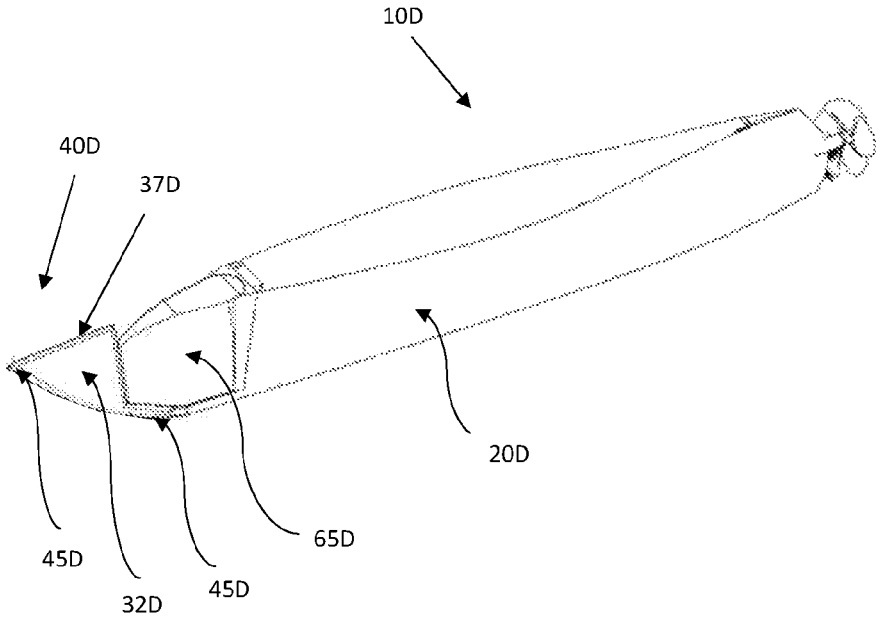
FIG. 1D is a schematic drawing of a grounding skeg according to a fourth preferred embodiment of the invention.

FIG. 1D depicts a grounding skeg 10D that is substantially the same as the grounding skeg 10C in FIG. 1C, except the aft end 40D includes a rudder blade 65D that tapers in the direction towards the pointed tip 45D. The rudder blade 65D is housed by the body 20D, and the sacrificial 'shoe'

37D comprising the triangular section 32D and the connection portion 35D. The rudder blade 65D is wedge shaped and has a width which tapers in the direction towards the pointed tip 45D. The 'shoe' 37D housing the rudder blade 65D protects the rudder blade 65D from forces that would otherwise act on the blade 65D during astern grounding/beaching and/or setting off.

Figure 1E:
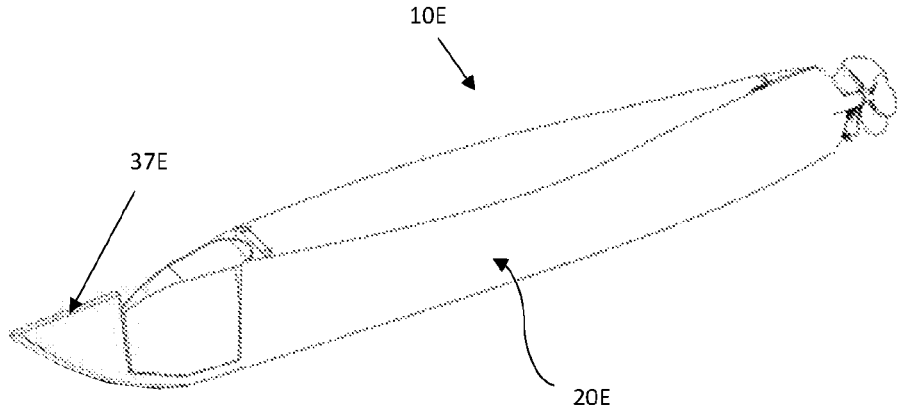
FIG. 1E is a schematic drawing of a grounding skeg according to a fifth preferred embodiment of the invention.

FIG. 1E shows a grounding skeg 10E that is substantially the same as the grounding skeg 10D in FIG. 1D, except that the 'shoe' is not sacrificial. The body 20E of the skeg 10E incorporates the 'shoe' 37E in that the shoe 37E is integral with the skeg body 20E.

The grounding bodies 20B, 20C, 20D, 20E are made of mild steel. Alternatively, they may be made of high tensile steel, duplex stainless steel, or even Aluminium (if sufficiently thick).

Figure 2:
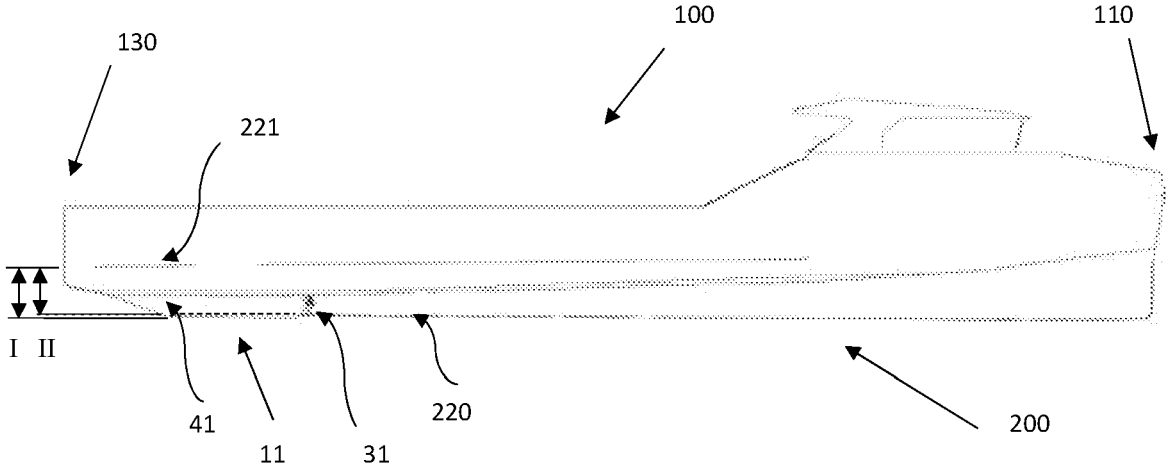
FIG. 2 is a side view schematic drawing of a craft having a hull that includes two integrated rudderless grounding skegs, according to a preferred embodiment of the invention.
Figure 2A:
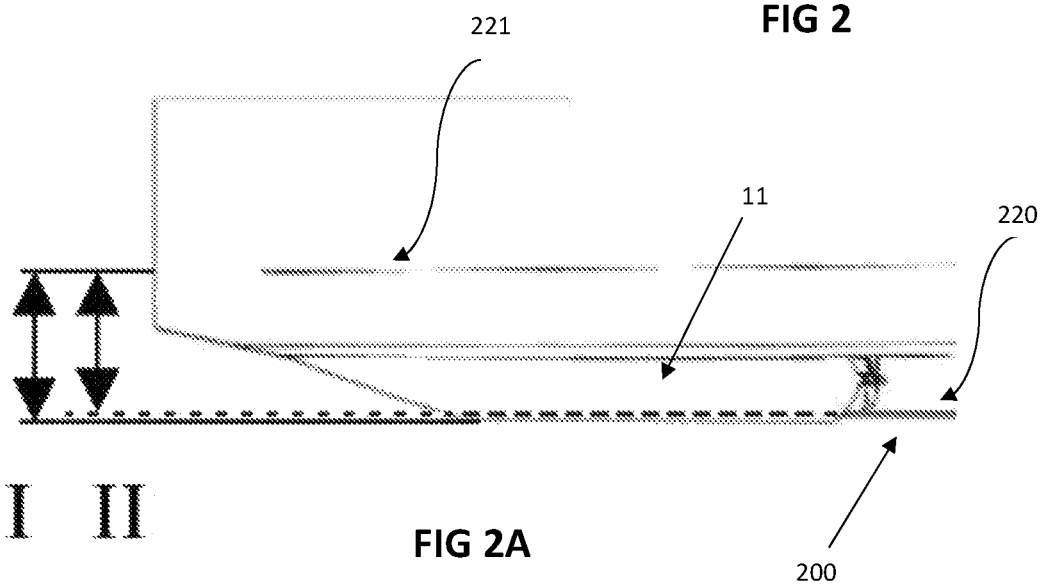
FIG. 2A is a zoomed in segment of FIG. 2.
Figure 3:
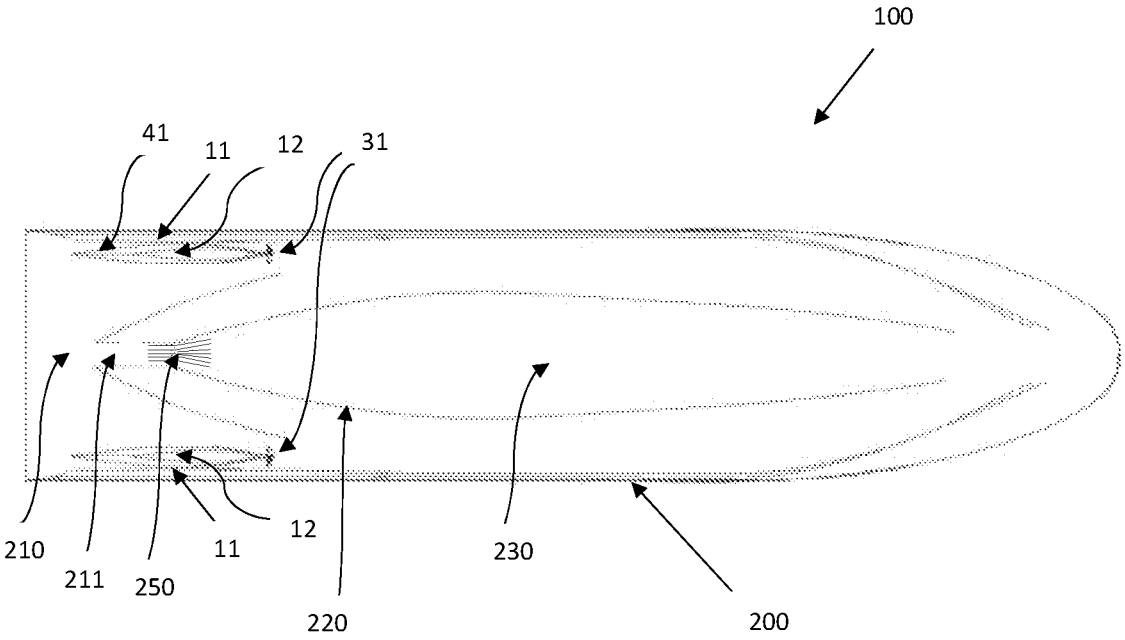
FIG. 3 is a bottom view schematic drawing of the craft of FIG. 2.

Turning to FIGS. 2, 2A and 3, there is depicted a stern landing craft 100 including a boat hull 200, the boat hull including two grounding skegs 11 which are substantially the same as the grounding skegs 10 described above and depicted in FIGS. 1A to 1E, with the exception that each of the grounding skegs 11 are integrally formed in the hull 200 (and open into the hull). The hull 200 is made from a high tensile steel material. Alternatively, it may be made from mild steel, aluminium, GRP or any suitable marine material known to the person skilled in the art, or any combination of the foregoing.

As is visible in FIG. 3, the hull 200 includes a keel 220 and two grounding skegs 11, one located on either side of the keel 220.

The two grounding skegs 11 each have a depth that is slightly greater than the depth of the hull 200. Referring to FIGS. 2 and 2A, in particular, the depth of the grounding skeg 11, represented by the symbol "I", extends between the design water line 221 of the hull 200 and the lowermost part of the skeg 11. The depth of the hull 220, represented by the symbol "II", extends between the design water line 221 of the hull 200 and lowermost part of the hull 200. Alternatively, the depth of the grounding skegs 11 may be the same depth as (or even slightly less than) the depth of the keel 220 of the main hull 200. It can also be seen in FIG. 2A that the lowermost part of the propeller blades 31 do not extend below the lowermost part of the skeg 11 and are substantially of the same depth (locally, at least) as the lowermost part of the hull 200.

Referring now to FIG. 3, the grounding skegs 11 are located at an outboard location adapted to independently control the landing or setting off of the stern landing craft 100. The two grounding skegs 11 are located aft of the midships of the landing craft 100, and proximate to the stern 130 of the stern landing craft 100. The fore end of each of the grounding skegs 11 faces the bow end 110 of the landing craft 100, and the aft end of each of the grounding skegs 11 faces the stern end 130 of the landing craft 100.

The propeller 31 of each grounding skeg 11 is located aft of the midships of the stern landing craft 100. The hull 200 is configured such that the two grounding skegs 11 are adapted to provide the first point of contact with the ground during landing of the stern landing craft 100, as the aft portions (i.e. tapered ends 41) of the skegs 11 extend deeper and are more aft than the corresponding aft portion of the transom 210.

The tapered end 41 of each of the grounding skegs 11 (only one of which is marked on FIG. 3) is located closer to the stern 130 of the craft than the angled portion 211 of the transom 210. The aft part of the flat bottom portion 12 of each of the grounding skegs 11 is located closer to the stern 130 of the craft 100 than the aft part of the flat bottom portion 230 (i.e. the keel plate) of the hull 200. This configuration aids one or both of the grounding skegs providing the earlier point(s) of contact than the transom/keel during landing.

The hull 200 is a flat bottom V-shaped hull. Alternatively, the hull may be V-shaped without including a flat bottom (in this arrangement the grounding skegs would have suitably configured flat bottom surfaces to provide stability), or the hull may have a wider or narrower flat bottomed shape (the wider flat bottom shaped hull would typically require ballast).

Included in the hull 200, around the lower part of the transom 210 and the flat bottom portion 230 there are provided longitudinal rubbing strakes 250 that protect the hull when the craft is grounding out (i.e. setting off, or debeaching), grounding (i.e. landing, or beaching) or grounded (i.e. landed, or beached). These rubbing strakes 250 include a half found steel pipe and are replaceable such that they can be replaced at dry dockings. In alternative embodiments, rubbing strakes having a different form may be provided, or no rubbing strakes may be provided at all.

It will be understood by the person skilled in the art that the configuration of the boat hull presented in FIGS. 2 and 3 is just one form of hull incorporating the grounding skegs that fall within the scope of the invention the subject of this specification. The grounding skegs need not be integrally formed with the hull (e.g. they could be welded on), and the skeg shape and depths, location of the propellers, hull shape (i.e. keel and/or transom shape), or other features of the hull may be adapted to suit the particular requirements of the craft (e.g. for obtaining preferred speeds or deadweight tonnage, for long distance transportation, or for grounding on certain grades or types of land). It will be understood by the skilled addressee that various combinations and configurations of one or more grounding skegs including the pulling propeller, may be applied, separately or together with conventional (i.e. pushing) propellers and/or skegs incorporating conventional (i.e. pushing) propellers.

In a particular embodiment, the boat hull of the invention may take the configuration illustrated in FIG. 4, which will be described in more detail below.

Figure 4:
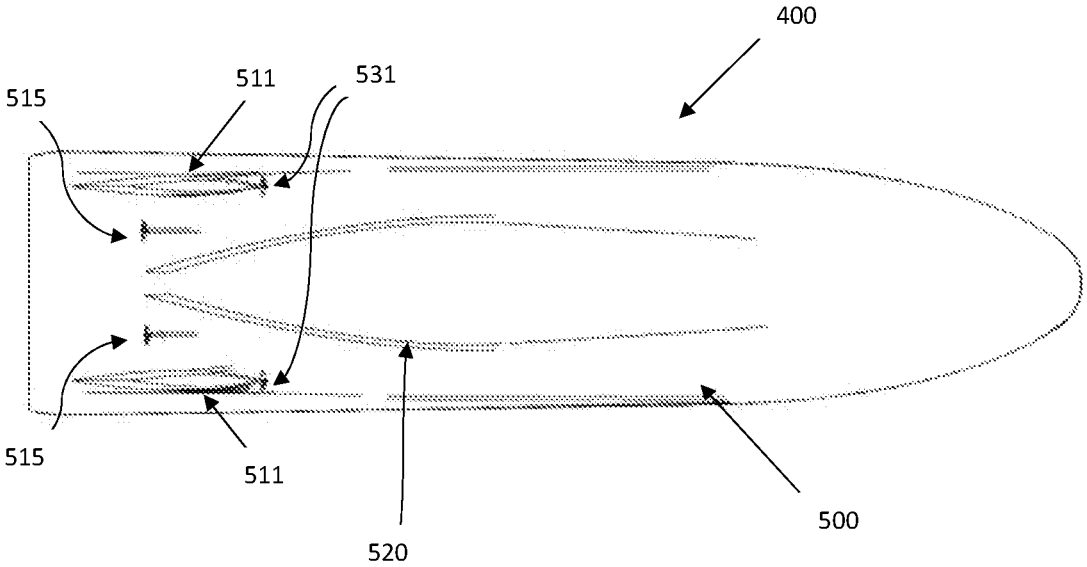
FIG. 4 is a bottom view schematic drawing of a hull including two grounding skegs, according to a further preferred embodiment of the invention.

In FIG. 4, there is depicted a boat hull 500 (being the underside of craft 400) that is substantially the same as the boat hull 200 depicted in FIG. 3, except that hull 500 includes two conventional (i.e. pushing) propellers 515 in addition to two grounding skegs 511 incorporating pulling propellers, and hull 500 does not have rubbing strakes. The shape of the keel of hull 500 is also modified.

Figure 5:
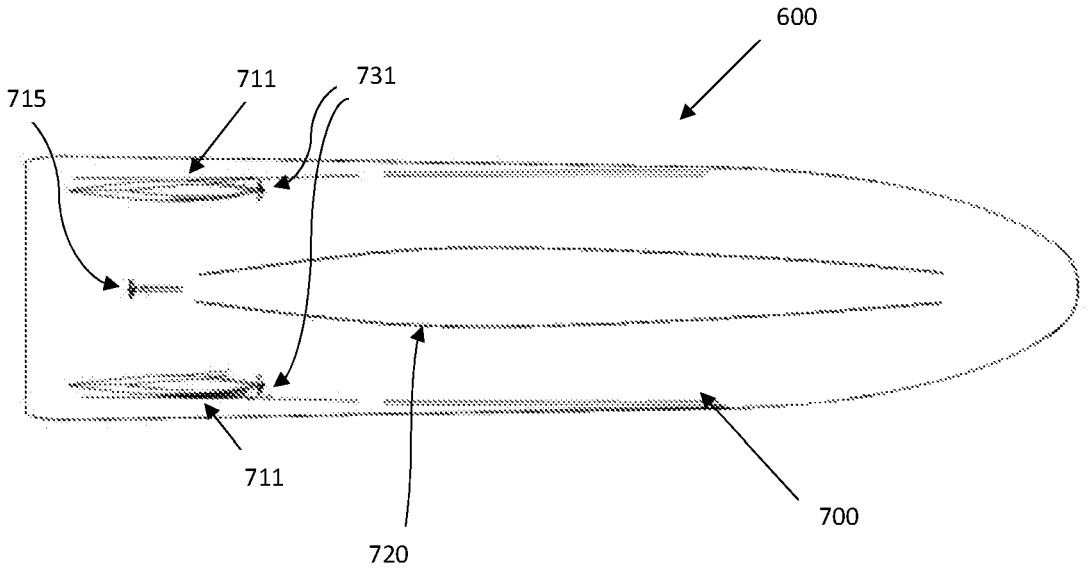
FIG. 5 is a bottom view schematic drawing of a hull including two grounding skegs, according to a further preferred embodiment of the invention.

In an alternative configuration depicted in FIG. 5, boat hull 700 (being the underside of craft 600) includes only one conventional (i.e. pushing) propeller 715 located centrally near the stern end of the hull 700. The keel 720 is different to the keel 220/520 of FIGS. 3 to 4, in that it is narrower and does not extend as far towards the stern of the craft 600.

In a further alternative configuration (not shown), the one or two pushing propellers in FIGS. 4 and 5 could be changed to pulling propeller/skegs in accordance with the invention, if the main hull is shaped accordingly to allow for good water flow into these inboard propellers.

In further alternative configurations (also not shown) the conventional propellers may be housed in respective grounding skegs, for use in combination with the grounding skegs incorporating pulling propellers.

Operation

The grounding skeg 10 in FIG. 1 is able to be attached to a hull of a craft via bolt holes 90, that are located on the upper surface of the skeg 10 (which surface is adapted to match a lower surface of the hull to which the skeg 10 is to be attached). Alternatively, the bolt holes may be located on the edges and include a flange for improved attachment. In another form, the bolt holes may not be included and the grounding skeg 10 may be welded into place on the hull. The electric motor 80 and rudder 60 are each connectable to a power source and controller in the vessel via electrical connections in the bolt hole 91, which is sealed in a watertight manner. Alternatively, and in particular in relation to the grounding skegs 10B, 10C, 10D and 10E depicted in FIGS. 1B, 1C, 1D and 1E, respectively, the grounding skeg may be welded to the main hull such that the skeg would be open into the main hull, so the electrical cable controllers could come in at any point from above.

The controller controls the motor 80, which in turn operates to rotate the propeller shaft 70 and the pulling propeller 30 (both of which are removable from the rest of the skeg 10). The rudder 60, including the rudder blade 65, is wirelessly controlled by the controller to swing in the desired direction to manoeuvre the craft.

During operation, the rudder blade 65 is not required to manoeuvre when going astern as where there are is an arrangement of propellers 30 on either side of a keel, steering may be controlled by the relative speeds of the rotation of the propellers 30 during a landing operation. This decreases the likelihood of a landing surface damaging the rudder blade 65, which remains in line with and protected by the protective 'shoe'.

The craft 100 in FIGS. 2 and 3 is a stern landing craft and the propellers are powered by an electric motor (not shown) electrically connected to a power source and controller located in the craft 100 (also not shown). The stern landing craft 100 may be driven ahead and astern, depending on the orientation of the rotation of the propellers 31 as operated by the controller.

The two propellers 31 (like the propellers 30 of grounding skeg 10) may be operated at differing speeds and/or be operated such that the propeller blades of each rotate in different directions. In this manner, the propellers may be operated according the prevailing conditions in order to make the craft travel in the required direction.

The grounding skegs 11, being located on either side of the keel 220, house and protect the propellers 31, and provide for good water flow into the propellers 31.

As the craft 100 is driven astern towards a substantially uniform section of shore (such that the length of the craft 100 is perpendicular to the shore as it is driven astern, not shown), the aft end of the grounding skegs 11 provide the first point of contact with the ground during landing of the craft 100. Then, the keel 220 provides a further point of contact with the ground. Alternatively, depending on the geometry of the shore and the angle that the craft 100 arrives, the keel 220 and one or both grounding skegs 11 may contact the ground around the same time.

When grounded, the configuration of the hull 200 acts like a tripod in the arrangement depicted in FIGS. 2 and 3, in particular the central keel 220 is flanked by the two grounding skegs 11, such that the flat bottom portions of each (230 and 12, respectively), and the surrounding parts of the skegs 11 and keel 220 that engage with the ground, are able to act in combination to support the craft 100 in an upright position.

The grounding skegs 11 being positioned either side of the keel 220 of the hull 200 create a stable platform for the hull 200 when it is grounded. Stability is particularly useful where the tide has gone out and the stabilising buoyancy provided by the water is not present.

Since the two grounding skegs 11 each have a depth that is slightly greater than the depth of the keel 220, as described above, the grounding skegs 11 are able to sink slightly deeper into soft seabed than the keel 220.

Once grounded, a ramp (not shown) located in the stern 130 may be lowered and transported items (e.g. vehicles or equipment) are able to be unloaded, or items to be transported by the craft 100 are able to be loaded onto the craft 100.

When setting off, the propellers are rotated in a direction to propel the craft 100 ahead and away from the shore.

In relation to FIGS. 4 and 5, the twin conventional propellers 515 of craft 400, and the single conventional propeller 715 of craft 600, can provide additional propulsion to the respective craft in moving away from the shore. In particular, hulls 500, 700 provide multiple combination engines/propellers, therefore potentially greater power and speed for the vessel for limited propeller diameters. The two (or one) pushing propellers 515 (or 715) are not intended to be used for the beaching/grounding process to avoid their respective propeller damage, but rather only utilised when clear of the seabed to gain extra power/speed.

In other respects, the each of hulls 500, 700 and respective crafts 400, 600 in FIGS. 4 and 5 operate substantially in the same way as the hull 200 and craft 100 depicted in FIGS. 2 to 3.

Technical Performance

With reference to FIGS. 2, 2A and 3, since the grounding skegs 11 have a reversed orientation on the hull compared to a conventional stern landing craft, the propeller 31 pulls from the forward end of the grounding skeg 11 and the propeller 31 (and/or propeller shaft) can be removed from the grounding skeg 11 without interfering with the rudder 65 (as the propeller 31 is at the opposite end of the grounding skeg than in conventionally the case).

Now referring to FIG. 1, the grounding skeg 10 rudder blade 65 is also protected by the body 20 of the grounding skeg 10 (and the housing shoe), which provides improved protection compared to the more exposed rudder of a conventional stern landing craft. The 'shoe' comprises the triangular section 32 and the connection portion 35, such that when the grounding skeg 10 contacts a landing surface, the rudder blade 65 is protected from damaging contact with the landing surface. This 'shoe' is sacrificable and can be replaced relatively easily as it would be one of the first impact areas and can be get worn over time.

The pointed tip 45 and tapered ends 40, 50 more generally, provide for hydrodynamic performance (i.e. to provide improved water flow into the propellers, without 'snagging' the craft in the scenario they contact a ground surface (e.g. seabed) when operating in shallow waters.

As the outboard propellers 31/531/731 are closer to the midships in the proposed illustrative embodiment in FIGS. 2 and 3, and FIGS. 4 and 5, they provide a significant advantage over existing stern landing craft as this location mitigates potential damage on the propeller blades 31/531/731 during beaching and de-beaching procedures. Damage to propeller blades of existing stern landing craft may occur because of their high velocity speeds when turning and hitting something. However, in the illustrative embodiment of the subject invention, by the time the propellers 31/531/731 are near the ground (i.e. the craft 100/400/600 has been driven into a stable grounded location) the propellers are stationary, and if they do touch the ground, they do so with only a relatively lesser force. The propellers 31/531/731 are made from a material including NiAlBr (nickel aluminium bronze), or any other suitable propeller material known to the person skilled in the art that is strong enough to withstand, or otherwise configured to resist, these forces.

The stability provided by the 'tripod' type arrangement may be understood by comparing the proposed configuration of the hull 200 in FIGS. 2 and 3, the hull 500 in FIG. 4, or the hull 700 in FIG. 5, to a craft having a hull configuration where the grounding skegs are either substantially shallower than a flat bottom central keel, or the grounding skegs are absent. In such a configuration, during grounding the central keel would land on the beach, but given the flat bottom surface of the keel (assuming it is similar to the keel 220/520/720 of the hull 200/500/700) would not be sufficiently wide to provide stability by itself, and the craft will roll to one side (i.e. heel). The likelihood of rolling is increased due to cross winds, waves, currents or other environmental factors. The consequence of the rolling is that it becomes difficult to load or unload items over the ramp, due to the ramp being at an angle with respect to a level ground surface.

If the craft includes a hull configuration having three or four grounding skegs 11/511/711, the propellers 31/531/731 on the inboard grounding skegs (which have a depth less than the outboard skegs) are not used during the beaching/de-beaching process so as to not damage them. In such a configuration, only outboard propellers would be required to be used during this process.

Other benefits that the proposed skeg and hull configuration has over conventional landing craft, whether existing stern landing craft (preferable) or other landing craft include, for example, not requiring a wide flat hull, due to the grounding skegs providing a balancing effect together with the central keel, a wider variety of hull designs for landing craft can be pursued, permitting improved craft manoeuvrability and/or speed.

General Statements

It will be appreciated by those skilled in the art that many modifications and variations may be made to the embodiments described herein without departing from the spirit and scope of the invention.

Throughout the specification and claims, the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features, that it directly references, but also other components, steps or features not specifically listed, unless the contrary is expressly stated or the context requires otherwise.

In the present specification, terms such as "part", "component", "means", "section", "segment", or "portion" may refer to singular or plural items and are terms intended to refer to a set of properties, functions or characteristics performed by one or more items having one or more parts. It is envisaged that where a "part", "component", "means", "section", "segment", "portion" or similar term is described as consisting of a single item, then a functionally equivalent object consisting of multiple items is considered to fall within the scope of the term; and similarly, where a "part", "component", "means", "section", "segment", "portion" or similar term is described as consisting of multiple items, a functionally equivalent object consisting of a single item is considered to fall within the scope of the term. The intended interpretation of such terms described in this paragraph should apply unless the contrary is expressly stated or the context requires otherwise.

The term "connected", "attached" or a similar term, should not be interpreted as being limitative to direct connections or attachments only. Thus, the scope of the expression a device A connected to a device B should not be limited to devices or systems wherein an output of device A is directly connected to an input of device B. It means that there exists a path between an output of A and an input of B which may be a path including other devices or means. "Connected", "attached" or a similar term, may mean that two or more elements are either in direct physical or electrical contact, or that two or more elements are not in direct contact with each other yet still co-operate or interact with each other.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Similarly it should be appreciated that in the above description of example embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

The dimensions provided in relation to the illustrative grounding skeg or boat hull are not intended to be prescriptive of all that falls within the scope of the invention. For example, the grounding skeg may be used in craft other than boats, for example submersible craft. The dimensions are provided for illustrative purposes only and should not be construed otherwise.

The mere disclosure of a product element in the specification should not be construed as being essential to the invention claimed herein, except where it is either expressly stated to be so or expressly recited in a claim.

The terms in the claims have the broadest scope of meaning they would have been given by a person of ordinary skill in the art as of the relevant date.

The terms "a" and "an" mean "one or more", unless expressly specified otherwise.

Neither the title nor any abstract of the present application should be taken as limiting in any way the scope of the claimed invention.

Where the preamble of a claim recites a purpose, benefit or possible use of the claimed invention, it does not limit the claimed invention to having only that purpose, benefit or possible use.

INDUSTRIAL APPLICABILITY

It is apparent from the above, that the arrangements described are applicable to the maritime industries.

The invention claimed is:

1. A grounding skeg for a landing craft configured for stern landing onto, and setting off from, a ground surface, the grounding skeg including:

an elongate grounding body having a fore end and an aft end; and a removable pulling propeller functionally connected to the fore end of the body;

wherein the pulling propeller is able to drive the landing craft ahead and astern; and the grounding body is locatable on the landing craft such that:

the grounding body provides contact with the ground surface during stern landing of the landing craft;

the fore end of the grounding body faces a bow end of the landing craft; and the aft end of the grounding body faces a stern end of the landing craft; and wherein the grounding body is adapted to be located on the landing craft such that the aft end of the grounding body provides the first point of contact with the ground surface during stern landing of the landing craft.

2. The grounding skeg according to claim 1, wherein the grounding skeg includes a rudder.

3. The grounding skeg according to claim 2, wherein a rudder blade of the rudder is located at, or towards, the aft end of the grounding body.

4. The grounding skeg according to claim 3, wherein the rudder blade is at least partially housed within the body.

5. The grounding skeg according to claim 4, wherein the grounding body is adapted for protecting the rudder blade during stern landing of the landing craft.

6. The grounding skeg according to claim 3, wherein the grounding body includes a tapered end and the rudder blade is housed within the tapered end of the body.

7. The grounding skeg according to claim 6, wherein the aft end of the grounding body is tapered and the rudder blade is housed within the tapered aft end of the body.

8. The grounding skeg according to claim 7, wherein a fore end of the rudder blade has substantially the same width as, or is narrower than, the tapered aft end of the grounding body that houses the fore end of the rudder blade.

9. The grounding skeg according to claim 8, wherein the aft end of the rudder blade has substantially the same width as, or is narrower than, the tapered aft end of the grounding body that houses an aft end of the rudder blade.

10. The grounding skeg according to claim 4, wherein the rudder blade is tapered such that, when the rudder blade is in-line with the grounding body, an outer surface of the grounding body forms a substantially continuous surface with the rudder blade.

11. The grounding skeg according to claim 4, wherein the grounding body includes a protective housing around at least the lower portion of the rudder blade, to protect the rudder blade during stern landing of the landing craft.

12. The grounding skeg according to claim 1, wherein the pulling propeller is able to be removed from the grounding skeg independently of the rudder.

13. The grounding skeg according to claim 1, wherein a propeller shaft connected to the pulling propeller is able to be removed from the grounding skeg independently of the rudder.

14. The grounding skeg according to claim 1, wherein the grounding skeg houses an electric motor or a conventional combustion engine, or a part thereof, for operating the pulling propeller.

15. The grounding skeg according to claim 1, wherein the grounding skeg is attachable to a hull of the landing craft.

16. The grounding skeg according to claim 15, wherein the grounding skeg is able to be retrofitted to the hull.

17. The grounding skeg according to claim 1, wherein the propeller is adapted to drive the landing craft astern while the aft end of the grounding body provides contact with the ground surface during stern landing of the landing craft.

18. The grounding skeg according to claim 1, wherein the propeller is sized such that it does not exceed a lowermost extremity of the fore end of the grounding skeg.

19. The grounding skeg according to claim 18, wherein a size of the propeller and its location at the fore end of the elongate grounding body enables the propeller to drive the landing craft astern while the grounding body provides contact with the ground surface during stern landing of the landing craft.

20. The grounding skeg according to claim 1, wherein the propeller is adapted to provide an additional sternwards thrust to an extant sternwards momentum of the landing craft during stern landing, said additional thrust combining with the extant sternwards momentum to drive the stern landing vessel further into the ground surface than would be the case without said additional sternwards thrust.

21. A hull for a landing craft, the hull including at least one grounding skeg according to claim 1.

22. The hull according to claim 21, wherein the at least one grounding skeg comprises one or more grounding skegs on each side of a hull centreline.

23. The hull according to claim 21, wherein two or more grounding skegs are located at an outboard location and adapted to independently control the landing or setting off of the landing craft.

24. The hull according to claim 21, wherein the at least one grounding skeg has a draft that is substantially similar to, or slightly greater than, the hull draft.

25. The hull according to claim 21, wherein the at least one grounding skeg is located proximate to the stern end of the landing craft.

26. The hull according to claim 21, wherein the hull is generally V-shaped.

27. The hull according to claim 21, wherein the hull is adapted to receive the at least one grounding skeg as a retrofit.

28. The hull according to claim 27, wherein the hull includes at least one elongate planar surface for retrofit engagement with an elongate upper surface of the grounding skeg.

29. A landing craft including the grounding skeg according to claim 1.

30. A landing craft including the hull according to claim 21.

* * * * *